US006412862B1

(12) United States Patent
Dickerson et al.

(10) Patent No.: US 6,412,862 B1
(45) Date of Patent: Jul. 2, 2002

(54) MOUNTING SOCKET FOR USE WITH UPHOLSTERED FURNITURE

(76) Inventors: Randy Wayne Dickerson, 402 Evergreen La., Thomasville, NC (US) 27360; Eddie Clifton Brinkley, 1550 Smith Farm Rd., Lexington, NC (US) 27292

( * ) Notice: Subject to any disclaimer, the term of this patent is extended or adjusted under 35 U.S.C. 154(b) by 0 days.

(21) Appl. No.: 09/670,757

(22) Filed: Sep. 27, 2000

(51) Int. Cl.[7] ..... A47C 7/62

(52) U.S. Cl. ..... 297/188.14; 297/161; 297/170; 297/173; 297/188.18

(58) Field of Search ..... 297/188.14, 188.18, 297/160, 161, 170, 173

(56) References Cited

U.S. PATENT DOCUMENTS

| | | | | |
|---|---|---|---|---|
| 1,285,146 A | * | 11/1918 | Harris | 297/188.18 X |
| 2,300,608 A | * | 11/1942 | Yusek | 297/170 |
| 3,586,368 A | | 6/1971 | Guild | 297/161 X |
| 4,300,798 A | | 11/1981 | Musgrove et al. | |
| 4,524,701 A | | 6/1985 | Chappell | |
| 4,575,149 A | | 3/1986 | Forestal et al. | |
| 4,913,393 A | | 4/1990 | Wood | 297/188.18 X |
| 5,026,114 A | | 6/1991 | Miller | |
| 5,050,929 A | | 9/1991 | Gueringer et al. | |
| 5,292,173 A | | 3/1994 | Lambert | 297/161 |
| 5,573,301 A | | 11/1996 | Scott | |
| 5,611,513 A | * | 3/1997 | Rosen | 297/188.18 X |
| 5,765,911 A | | 6/1998 | Sorenson | 297/173 |
| 5,806,464 A | | 9/1998 | Willinger et al. | |
| 5,865,124 A | | 2/1999 | Wroe | |
| 5,893,607 A | | 4/1999 | Trimnell | |
| 5,899,526 A | | 5/1999 | LaPoint et al. | 297/173 |
| 5,909,864 A | | 6/1999 | Wang | 297/173 X |

* cited by examiner

*Primary Examiner*—Jose V. Chen
*Assistant Examiner*—Rodney B. White
(74) *Attorney, Agent, or Firm*—Robert W. Pitts

(57) ABSTRACT

An assembly for mounting a table, tray or other removable component to a chair to support a laptop computer or other appliance includes a socket that can be permanently mounted in the chair arm and a bracket or mounting assembly that can be mounted on the bottom of the removable component. The socket includes a sleeve with a collar mounted on the top of the sleeve. The collar surrounds the area around a hole in the chair arm through which the socket sleeve extends. The sleeve is attached to an internal frame member. A spring biased plug shifts within a cavity in the sleeve. A rigid pin located on the bottom of the removable component is inserted through a central opening in the collar into the cavity, forcing the plug into the sleeve. The table is firmly supported by the socket, but it is free to rotate in a horizontal plane.

20 Claims, 7 Drawing Sheets

MOUNTING SOCKET FOR USE WITH UPHOLSTERED FURNITURE

BACKGROUND OF THE INVENTION

1. Field of the Invention

This invention is related to tables or trays that can be mounted on a conventional piece of furniture, such as an upholstered chair, for use by the occupant of the chair. This invention is also related to a support device that can be used to position an appliance, such as a laptop computer, for use by an occupant of an arm chair.

2. Description of the Prior Art

It is often necessary that a table or tray or other horizontal surface be mounted on a chair for use by the occupant of the chair. Perhaps the most familiar of this devices is the traditional folding desks that have been used in classroom for many years. Tables have also been used in conjunction with wheelchairs for use by those confined in this manner. Numerous approaches for mounting the table or tray on chairs of this type have been proposed.

With the increasing popularity of laptop computers and other electronic appliances, several suggestions have been made for mounting tables or trays on otherwise conventional items of furniture, such as upholstered arm chair, have been suggested. For example, U.S. Pat. No. 5,050,929 shows a table that folds out from an arm of an upholstered chair. U.S. Pat. No. 5,765,911 shows a table that can be mounted on the side of an upholstered arm chair and can be stored by folding the table beside one arm of the chair. However, these devices involve folding and movable parts, and must either be stored on the outside of the chair where they remain visible or must require significant modifications to the construction of the chair if the table is to be stored on the interior of the chair.

Other potentially simpler devices have been suggested for use on desk chairs or seats used in classrooms or similar environments. Examples of such suggestions are found in U.S. Pat. Nos. 5,292,173; 5,573,301; 5,893,607; and 5,909,864. These later devices do not however appear suitable for use with upholstered furniture.

SUMMARY OF THE INVENTION

The instant invention provides a simple, inexpensive device for mounting a table of horizontal surface on a chair, such as upholstered chair, without major modification of the chair. The instant device also provides an unobtrusive means for mounting a removable component on an upholstered chair that is compatible with the appearance of the piece of furniture. This invention also permits the removable table to be stored out of the way when not in use. The only component that is permanently mounted in the chair is a relatively small cylindrical socket that can be mounted on a chair arm. A table or tray can then be mounted on this socket using a pin that is attached to the bottom of the removable table or tray.

A socket, according to this invention, is intended for use in mounting a component, such as a tray or table on a piece of furniture, such as an upholstered chair. This table can then be used to support a laptop computer or other appliance. The socket will then support the component and prevent damage to a surrounding surface of the piece of furniture. This socket includes a collar with a peripheral flange and a central opening for receipt of a pin attached to the component. The collar is attached to the first or upper end of a sleeve. A plug extends into the collar central opening and can be shifted relative to the collar and to the sleeve. A spring is located in the sleeve and supports the plug. The spring urges the plug to a position in which the plug closes the central opening. A spring stop is located on the sleeve at a distance from the first end so that the spring and plug are located between the first end and the spring stop. The sleeve can then be attached to the piece of furniture at a location spaced from the top where a component support pin is inserted. This increases the stability of the support. The component can be mounted on the piece of furniture by inserting the pin in the central opening, forcing the plug to a recessed position with the socket preventing the pin and the components from tilting relative to the socket and to the piece of furniture.

An item of furniture, such as a chair would thus include a socket for mounting a removable device on the item of furniture. The socket would have a collar attached to a sleeve. The collar extends over a portion of an exterior surface of the item of furniture, and the sleeve extends into the item and is attached to an interior frame member on the item of furniture. The socket further includes a central opening accessible from the exterior surface of the item of furniture with a plug extending into the central opening. The socket further includes a spring located in the sleeve and biasing the plug into a position closing the central opening. Compression of the spring by the plug opens the central opening so that the a portion of the removable device can be inserted into the central opening. The item of furniture includes a hole in the exterior surface having a diameter less than a diameter of the collar but greater than an outer diameter of the sleeve so that the socket can be inserted through the hole and mounted on the item of furniture with the collar extending over a portion of the exterior surface surrounding the hole.

An assembly according to another aspect of this invention is intended for use on a chair to support an appliance, such as a laptop computer, for use by the occupant of the chair. The assembly includes a socket with a sleeve and a collar on the top or first end of the sleeve. The collar has a peripheral flange extending annularly beyond the sleeve and a central opening extending through the collar and communicating with an interior cavity formed by the sleeve. The socket is mounted on the chair at a location spaced from the first end of the sleeve. The assembly also includes a removable table with a pin extending from a bottom surface of the table. The pin can be inserted into the central opening and is shorter than the sleeve, so that the table can be mounted on the chair and supported by the socket.

DETAILED DESCRIPTION OF THE PREFERRED EMBODIMENT

Figure 1:
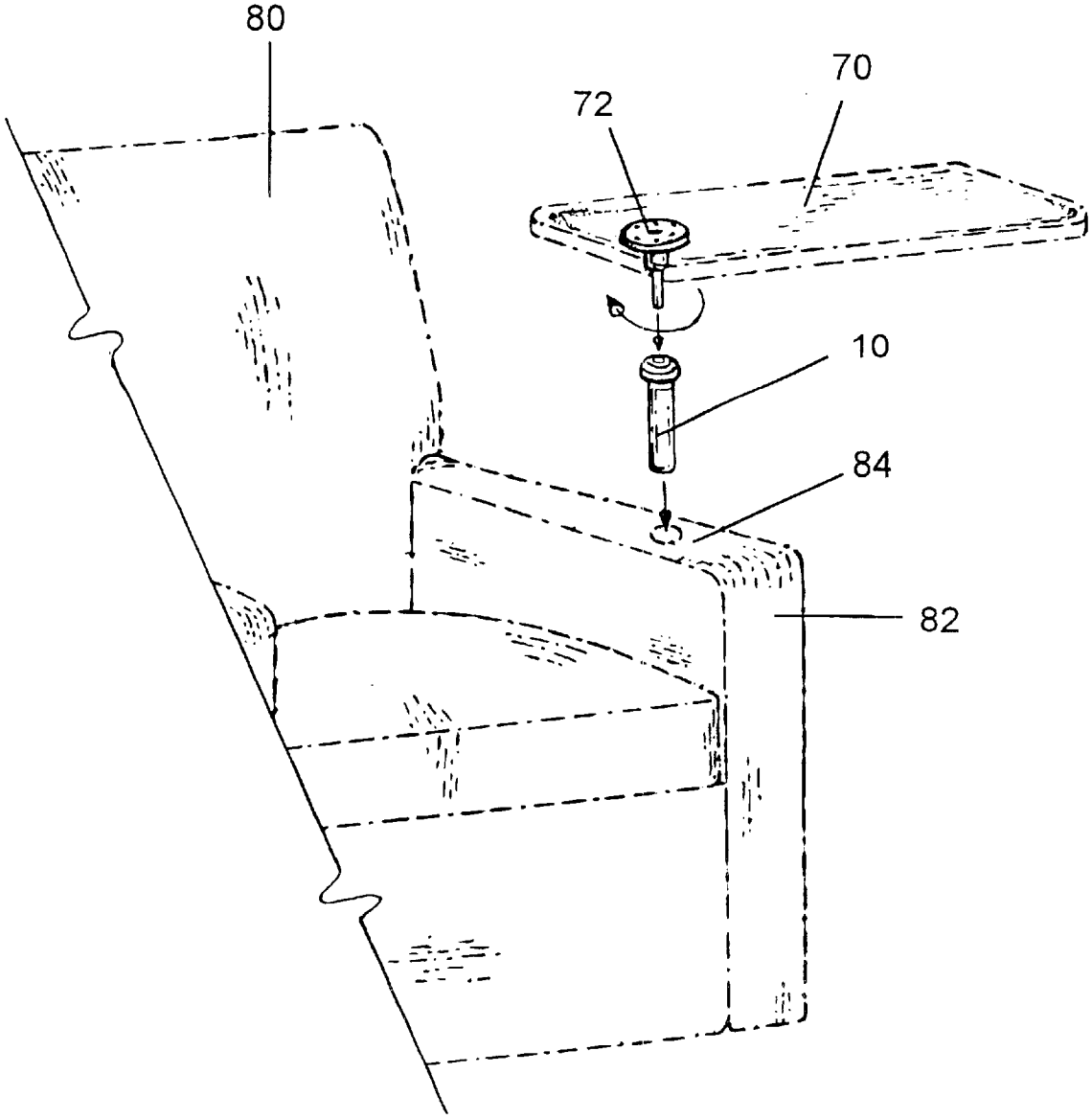
FIG. 1 is a view of a chair showing the mounting socket and a removable table exploded above an arm of the chair in which the mounting socket is located.

The component mounting assembly comprising the preferred embodiment of this invention comprises a socket 10 and a support subassembly 72 that can be mounted on a table or tray 70. This mounting assembly provides a convenient means for mounting a table or tray 70 on a chair or other piece of furniture 80 to which the socket 10 is permanently mounted. The preferred embodiment of this invention is intended for use with a chair 70 in which the socket 10 is attached to the internal frame 86 of the chair arm 82 with a collar 12 on the first end or top of the socket 10 extending over a surrounding portion of the top of an upholstered chair arm 82. The table mounting subassembly 72 includes a rigid pin 74 that can be inserted into a central opening 16 of the collar 12 so that the socket 10 supports a removable component, such as a tray or table 70 and prevents tilting. This tray or table 70 will then be positioned to support an appliance, such as a laptop computer or an electronic game or even a book in a convenient position for use by the chair's occupant.

Figure 2:
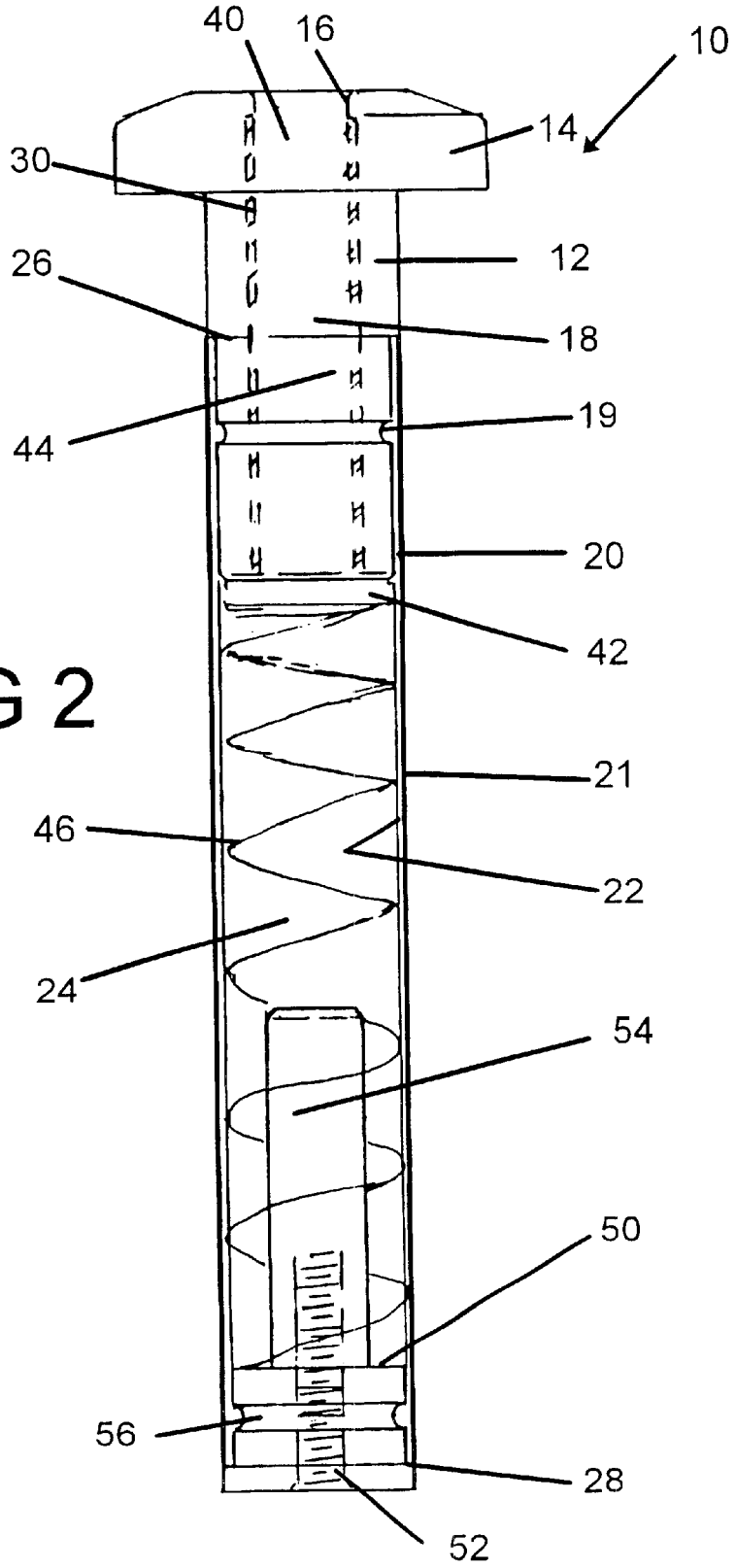
FIG. 2 is a view showing the components of the socket in an assembled configuration.
Figure 3:
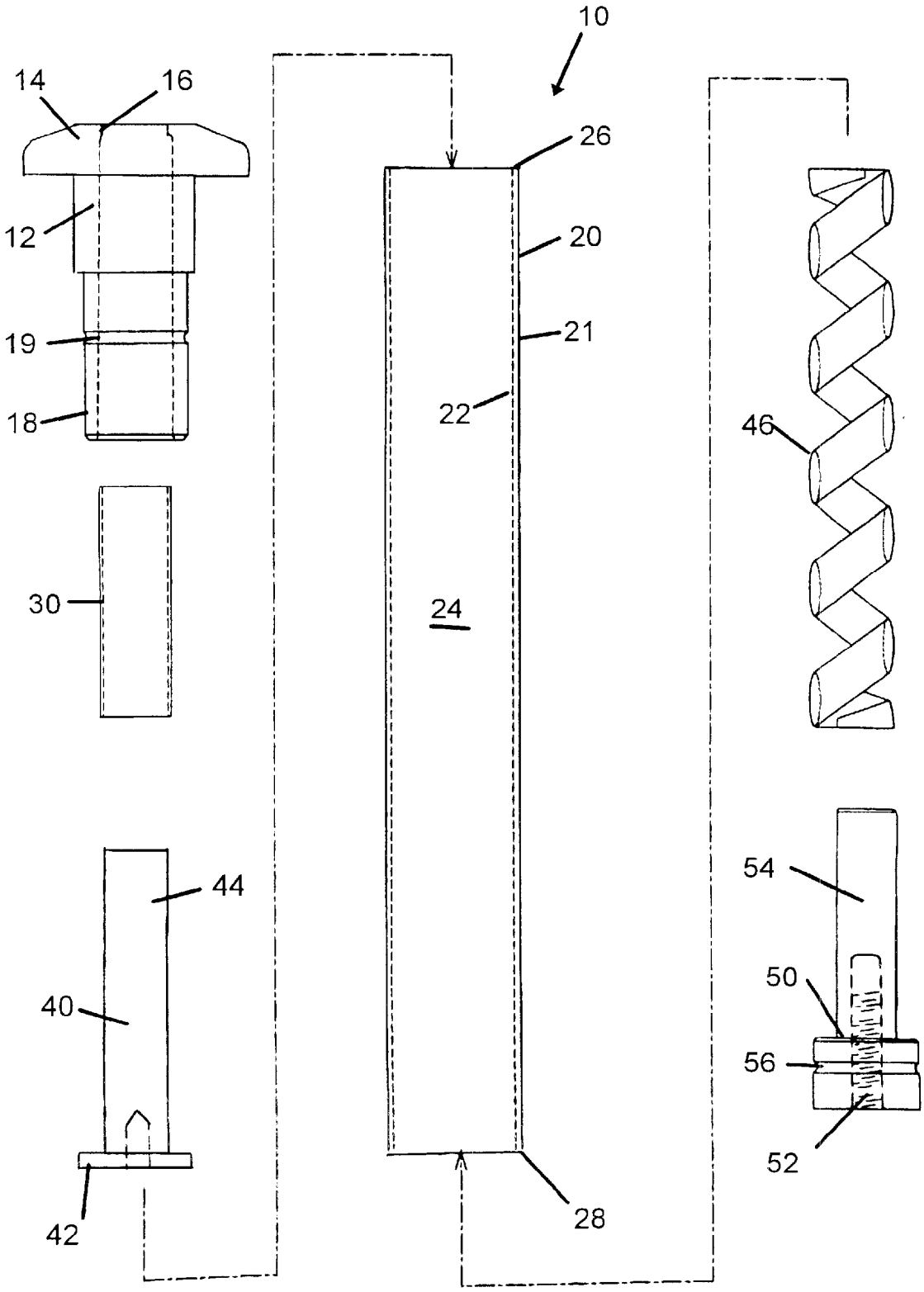
FIG. 3 is an exploded view showing he components of the mounting socket.

The individual components of the socket 10 are best seen in FIGS. 2 and 3. An outer cylindrical sleeve 20 houses the majority of the components forming the socket 10. In the preferred embodiment, this sleeve 20 comprises a rigid metallic tube having a length of approximately six inches and an outer diameter of approximately one inch. A cylindrical interior cavity 24 houses the majority of the subcomponents of the socket 10, but a portion of a collar 12 protrudes beyond the upper or first end 26 of the sleeve 20. A lower end cap or disk 50 closes the bottom or second end 28 of the sleeve 20. The interior cavity 24 is thus defined by the inner surface 22 of the sleeve 20 and is bounded on the top and bottom respectively by the lower end of the collar 12 and the upper surface of the end cap or disk 50. The outer surface 21 of sleeve 20 is smooth and both the collar 12 and the end cap 50 form continuations of this smooth outer surface so that there are no sharp corners or burrs.

The collar 12 has a smooth upper surface that is contoured to fit smoothly on the top of the chair 80 or other item of furniture on which the socket 10 is mounted. In the preferred embodiment, the collar 12 is fabricated from aluminum having a finished texture that has an attractive appearance when used on an upholstered chair arm 82. Of course other materials, such as a plastic having a suitable appearance, could be used. The collar 12 is generally cylindrical and has an upper peripheral flange 14 that protrudes substantially beyond a lower tubular section 18 that fits partially within the sleeve 20 at its upper end 26. This upper peripheral flange 14 comprises means for covering the edges of the upholstery on a chair arm 82 surrounding a hole through which the socket 10 extends. Peripheral flange 14 can have an outer diameter of approximately two inches when used with a sleeve having an outer diameter of approximately one inch.

A tubular section 18 extends downwardly from the bottom surface of the peripheral flange 14. The lowermost portion of this tubular section 18 is intended for insertion in the sleeve 20 at its upper end 26, and this lower portion of tubular section 18 has a diameter to provide a tight fit with the sleeve inner surface 22. A crimping groove 19 is formed in this lower section of the tubular section 18 so that when the sleeve 20 is crimped in this section, the collar 12 will be permanently attached to the collar 12. An upper portion of this tubular section has a diameter substantially equal to the outer diameter of the sleeve 20 so that collar forms an upward extension of the cylindrical outer sleeve surface 21.

Figure 4:
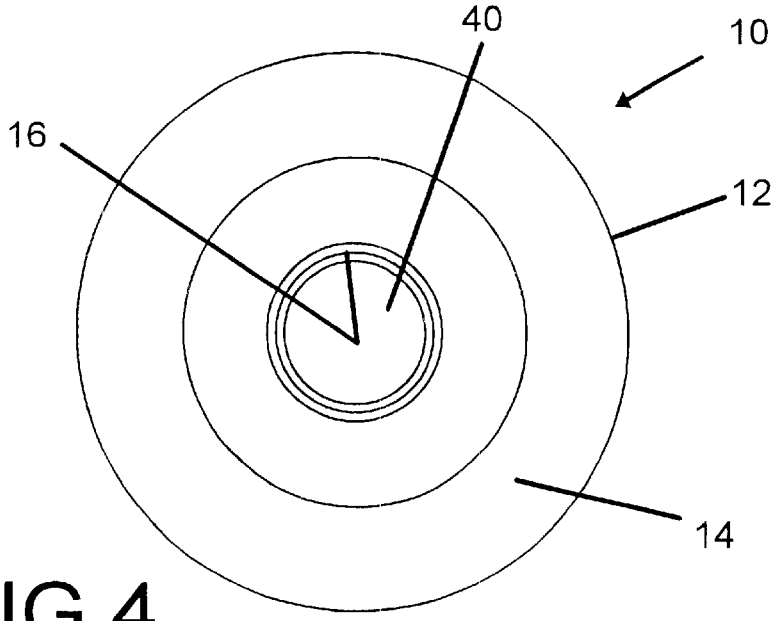
FIG. 4 is a top view of the socket collar.

A central opening 16 extends from the upper surface of the collar 12 through the lower end of the collar tubular section 16 so that a support pin 74 extending from the lower surface of the table or tray 70, or other component to be mounted on the item of furniture. This central opening 16 is stepped to provide space for a cylindrical bushing 30 which has a smooth inner surface. The smallest diameter section of the central opening 16 is located adjacent the top surface of the collar 16 so that the pin 74 will be held in a central position when inserted into the socket 10. As seen in FIGS. 2–4, the top surface of the collar 12 is tapered toward the outer edges and flat middle section surrounds the central opening 16. This contour provides not only a smooth surface on the top of an upholstered furniture piece, but also provides a suitable surface for positioning the pin 74 as the table 70 or similar component is mounted on the piece for furniture.

In the representative embodiment, a cylindrical plug 40 is positioned within the collar central opening 16 when a removable component 70 is not mounted on the socket 10. This plug serves to close the central opening 16 and provide a substantially smooth during those times when no component 70 is mounted on the socket 10. In the preferred embodiment, the plug 40 will be fabricated from the same material as the collar 12, although the plug 40 could be fabricated from a different material. Plug 40 has a base 42 that has a larger diameter than a plug shaft 44 that extends upwardly from the base 42. Both the base 42 and the shaft 44 are cylindrical. Base 42 is dimensioned to fit within the sleeve 20 and can slide smoothly along the inner sleeve surface 22 in the cavity 24. The plug shaft 44 is dimensioned to fit withing the bushing 30 located in the central collar opening 16. The plug shaft 44 is free to slide smoothly within the bushing 30, but is nevertheless held so that it will move smoothly in only and axial direction and will not hang up during movement relative to the collar 12. The top surface of the plug shaft fits smoothly with the flat uppermost section of the collar 12 with only a small beveled area interrupting the other wise smooth uppermost collar surface when the plug 40 is in its upper position in which the central collar opening 16 is closed. When the upper surface of plug shaft 44 is located at the uppermost extent of its travel, as shown in FIG. 2, the plug base 42 abuts the lower end of the tubular collar section 18.

The larger plug base 42 also serves as an upper spring stop or bearing surface engaged by the top of a coil spring 46 located within the sleeve cavity 24. This coil spring 46 biases the plug 40 toward its upper or closed position and has sufficient strength to keep the plug in this position until an external force is applied to move the plug 40 downward to compress the spring 46.

The lower end of the spring 46 abuts and annular top surface of a disk or lower end cap 50 which serves as a lower stationary spring stop. The plug base 42 can then be considered to be a movable spring stop. The end cap 50 fits within the lower or second sleeve end 28 and is permanently affixed to the sleeve 20 by crimping a portion of the sleeve 20 into a crimping groove 56 located on the exterior surface of the end cap 50. The end cap 50 also includes a threaded opening 52 extending to the open end of the cap 50 and an internal post 54 extending upwardly into the sleeve cavity 24. The threaded opening 52 also extends upwardly into the post 54. The coil spring 46 extends around the post 54 which has a sufficient height to abut the plug base 42 at the end of the travel of the plug 40. Post 54 thus serves as a plug stop and the combined length of both the plug 40 and the post 54, relative to the dimensions of the sleeve 20 and the collar 12 is such that the upper portion of the plug shaft 44 will remain within the portion of the central collar opening 16, occupied by the bushing 30, at the extreme extent of the plug travel. In this way a portion of the plug shaft 44 always remains within the collar 12. The treaded opening 52 along with a screw 60 serves as a means of attaching the socket 10 to a chair or other piece of furniture at the a position spaced from the top of the socket 10 and spaced from the exterior of the chair arm 82 or other suitable surface of a piece of furniture on which the socket 10 is to be mounted.

The other portion of this mounting assembly comprises a component or table support subassembly 72 that is permanently attached to a table or a tray 70 or other component that is to be removably mounted on the chair 80 or other item of furniture. This component support subassembly 72 comprises a rigid pin 74 that extends downwardly from a base 78. The pin has an upper section 75 and a lower section 76. The outer diameter of the lower section 76 is chosen so that this portion of the pin 74 can be inserted into the central collar opening 16. The outer diameter of the lower pin section 76 has approximately the same outer diameter as the plug shaft 44 so this portion of the pin 74 can smoothly slide into the central opening 16 and along the bushing 30, but the collar 12 will still provide sufficient lateral support to the rigid pin 74 to hold the table 70 is a stable position to permit use an appliance such as a laptop computer or electronic game without tilting. The upper pin section 75 has an outer diameter that is greater than the size of the central opening 16 and lends added strength to the pin. In some embodiments of this invention, this upper pin section 75 could rest against the top of the collar 12 to support the table 70. However, in the preferred embodiment of this invention the upper pin section 75 remains spaced from the uppermost surface of the collar 12 when the table 70 is mounted on the socket 10. This spacing insures that the collar is not marred during use and no cosmetic damage occurs. The length of the lower pin section 74 is less than the length of the collar central opening 16. When inserted into the collar 12, the pin 44 will engage the upper surface of the plug shaft 44 and force the plug 40 downward against the action of the spring 46 until the plug abuts the top of the post 54 in the lower portion of the sleeve cavity 24. The post 54 will then support the plug 40 which in turn supports the pin 74. Since the combined length of the post 54, the plug 40 and the pin 74 is greater than the length of the sleeve 20 and that portion of the collar 12 extending above the sleeve 20, the upper surface of the collar 12 will not be engaged by any surface on the table support subassembly. In addition to preventing damage to the collar 12 or to the upholstered exterior of the chair arm 82 or other surface of the item of furniture on which the table 70 is to be mounted, this configuration also permits the table 70 to freely rotate about the axis of the pin 74. The table 70 can thus be easily moved out of the way to permit an occupant to seat his or herself or to get up form the chair 80. A smooth cover piece can also be added to the end of the pin 74 if desired.

The pin 74 extend downwardly from the support base 78, which in the preferred embodiment comprises a generally circular plate, although the precise shape of the base 78 remains a matter of design choice. The pin 74 can be welded to the base 78 or it can be attached in any number of conventional ways. The base 78 also has a plurality of holes 79 that receive screws or other attachment means to secure the table support subassembly 72 to the table, tray or other component 70 with which it is to be used. With this support subassembly 70 attached to a component 70, it can be mounted on a piece of furniture by simply inserting the pin 74 vertically into the central collar opening 16.

Figure 6:
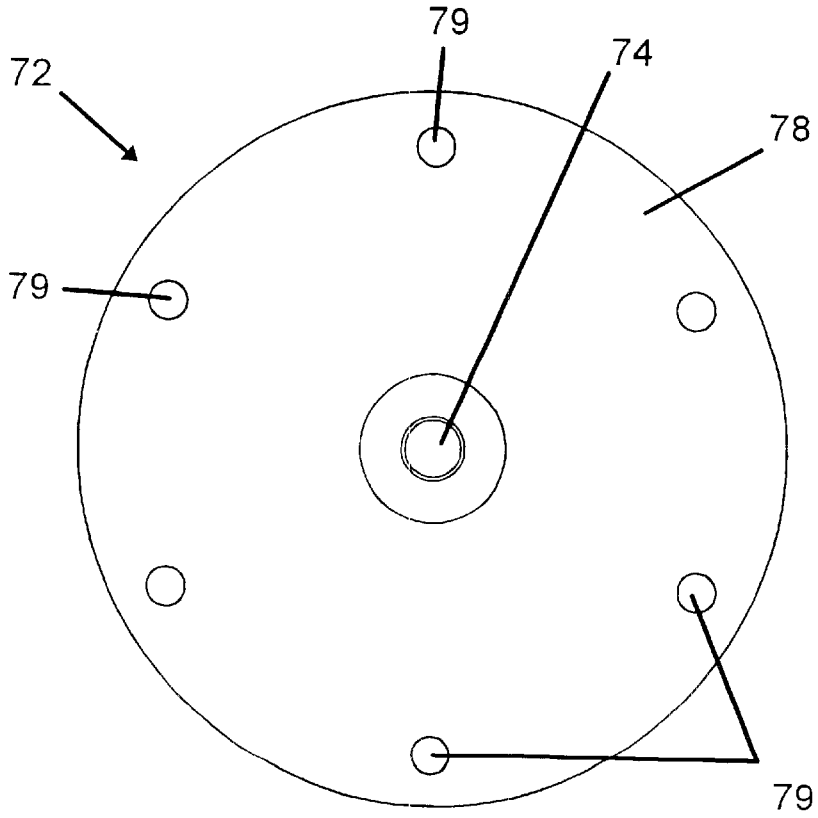
FIG. 6 is a bottom view of the table mounting subassembly.
Figure 5:
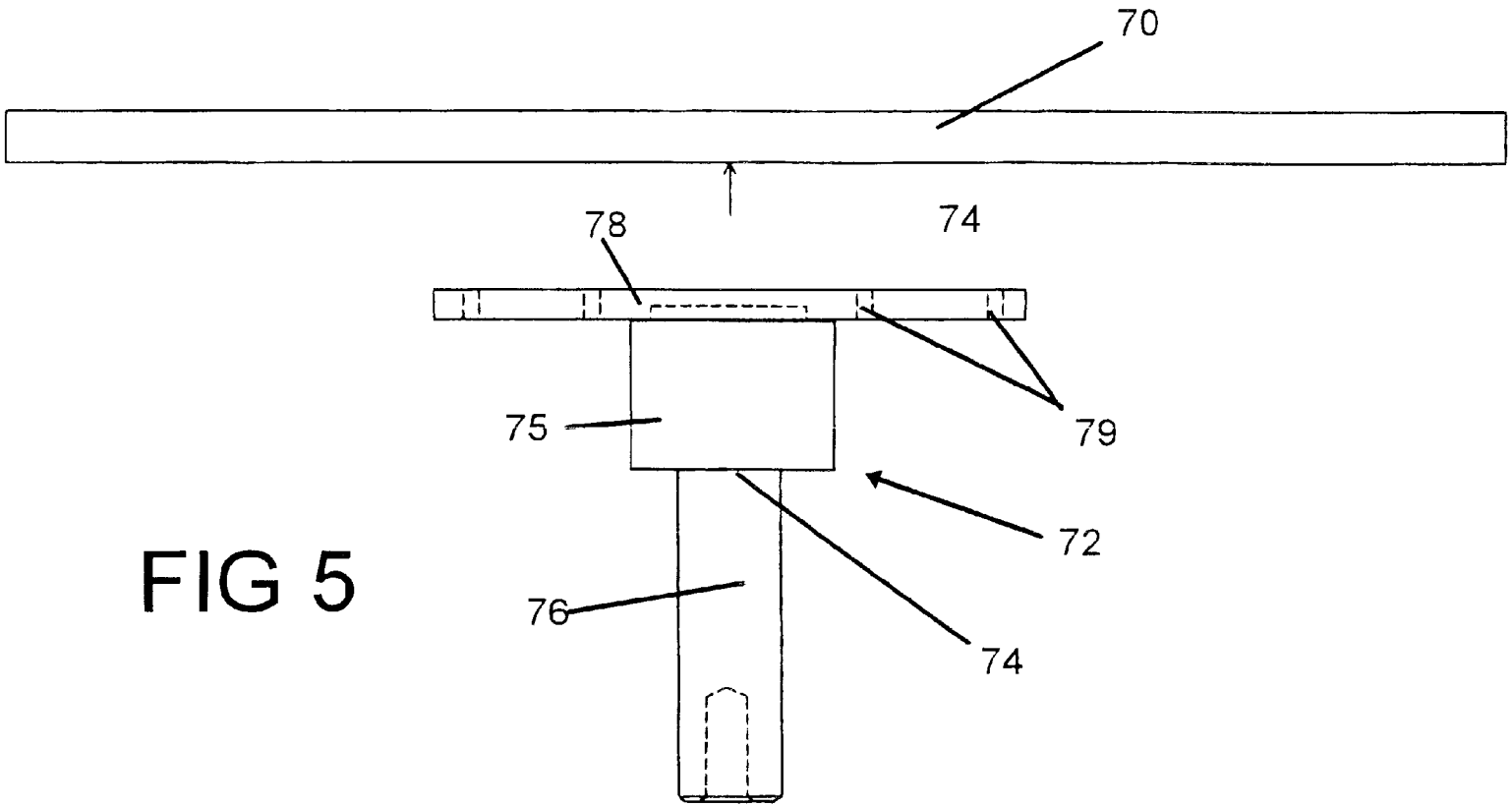
FIG. 5 is a side view of the mounting subassembly showing the manner in which it is to be attached to the bottom surface of a table or tray.
Figure 7:
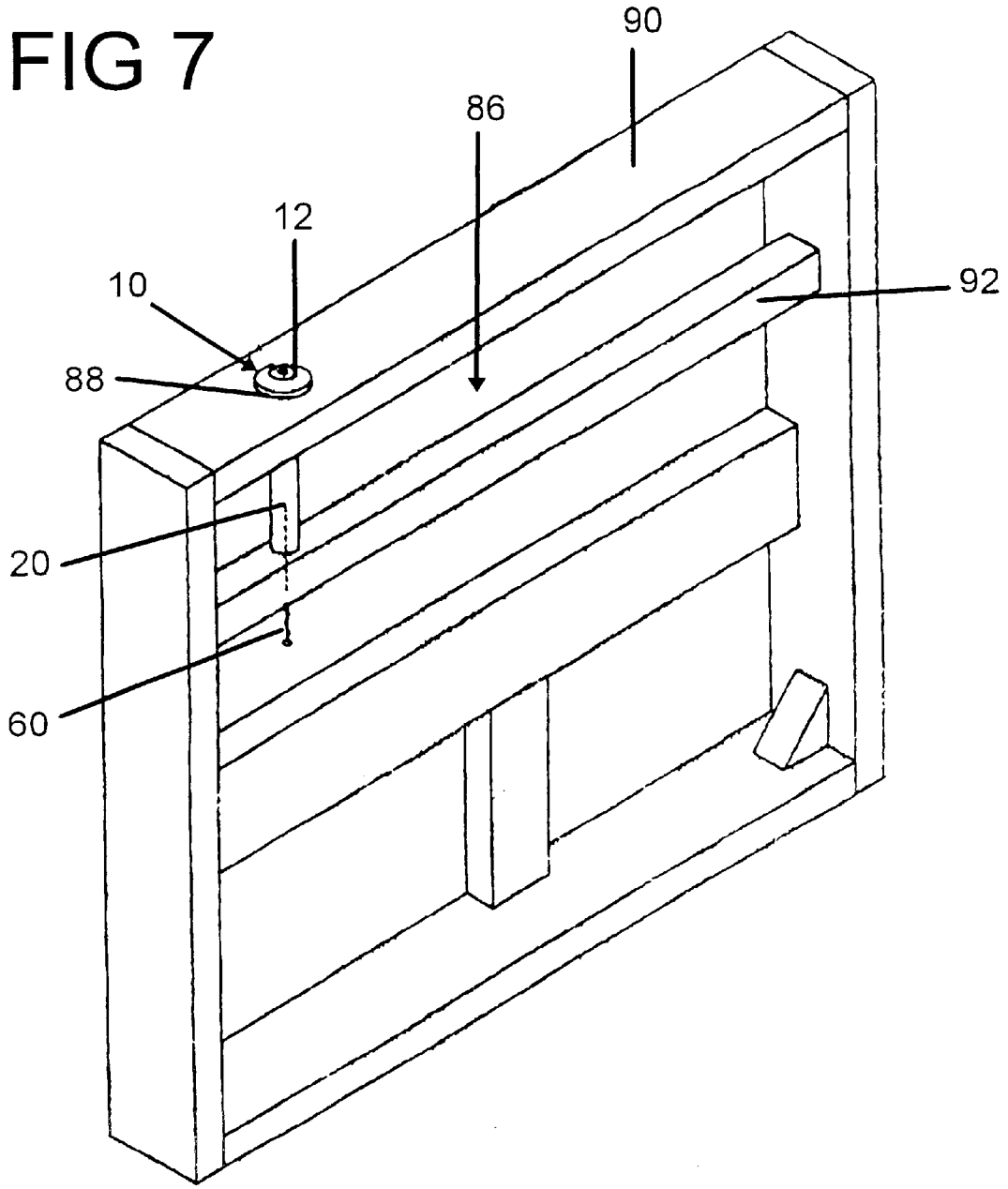
FIG. 7 is a view of an internal chair frame showing the manner in which the socket is attached to the chair frame.
Figure 8:
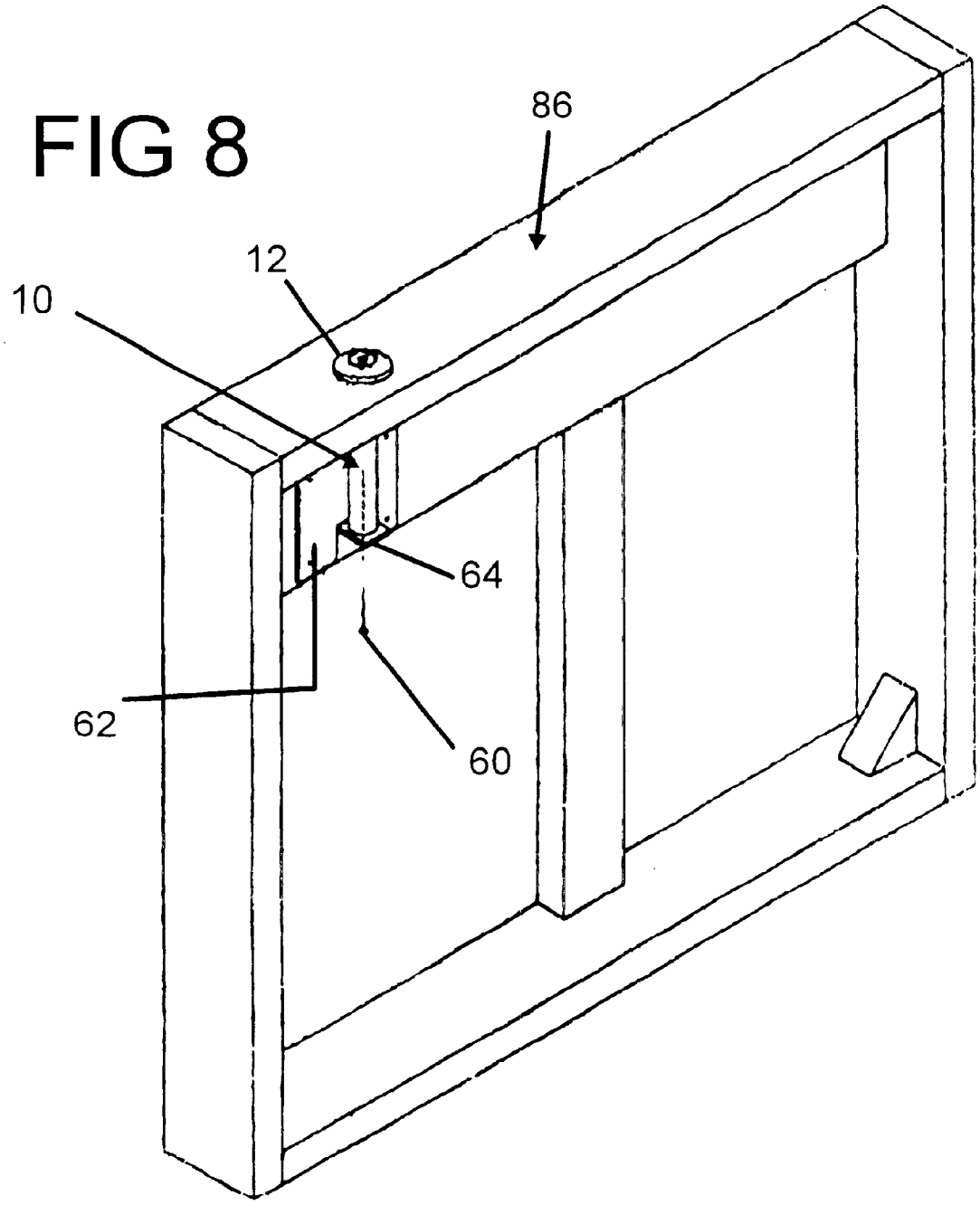
FIG. 8 is an alternate view of an internal chair frame showing another method of mounting the socket to the chair frame.

The socket 10 can be mounted to a frame 86 of a chair arm 82 in the manner shown in FIGS. 7 and 8. The socket sleeve 24 is first inserted through a hole 86 on the top beam 90 of the chair frame 86. As shown in FIG. 6, the socket 10 can be positioned in engagement with a second frame beam 92 with the end cap 50 abutting or in close proximity to this beam 92. A hole, not shown, would normally be provided in this beam 92 and a screw or bolt 60 would then be threaded into the threaded opening 52 at the base of the sleeve 20. The socket 10 would then be firmly attached at its lower end and would be supported by the frame hole 86 adjacent the top of the socket 10, insuring that the socket will be firm and stable when attached to the item of furniture. The component or table 70 could then be properly supported by the socket 10. The peripheral flange 14 also serves as a means to cover the edges of upholstery which is added to the frame 86 after the socket 10 is in place.

FIG. 8 shows an alternative means of attaching the socket 10 to the chair frame 86. In this configuration a mounting bracket 62 can be firmly attached to a vertical surface on the frame 86. This mounting bracket 62 would normally be fabricated as a rigid metal plate with a tab 62 extending at right angles to the remainder of the bracket 62. The socket 10 can then be positioned in engagement with the tab 62 and a screw, bolt or other fastener 60 can be inserted through a hole in the tab 62 into the treaded opening 52 in the sleeve end cap 50. In each case the socket will be firmly held in place.

Although it is believed that the representative embodiment of this invention provides a simple and improved means for attaching a component, such as a table, to an item of furniture, such as a chair, certain modifications are certainly possible. For example one version of this assembly could omit the spring biased plug 40. Either the central opening can remain unobstructed or a separate removable plug could be employed. In either case, the same table support subassembly 72 could still be used with either version. The table support assembly could be modified by providing a removable pin or by providing means for rotating the pin into a position flush with the support base when not in use. The preferred embodiment shown herein is thus merely representative of one embodiment and not all portions of the structure shown in this embodiment is necessary to practice this invention, which is defined by the following claims.

We claim:

1. A socket for use in mounting a component on a piece of furniture so that the socket comprises means both supporting the component and preventing damage to surrounding surface of the piece of furniture, the socket comprising:

a collar having a peripheral flange and a central opening for receipt of a pin located on the component;

a separate sleeve, the collar adapted to be attached to a first end of the sleeve with the peripheral flange extending outwardly from and laterally beyond the sleeve;

a plug extending into the collar central opening and shiftable relative to the collar and to the sleeve;

a spring located in the sleeve and supporting the plug, the spring urging the plug to a position in which the plug closes the central opening;

a spring stop located on the sleeve at a distance from the first end so that the spring and plug are located between the first end and the spring stop, and means for attaching the sleeve to the piece of furniture at a distance from the surrounding surface of the piece of furniture and from the collar, whereby the component is adapted to be mounted on the piece of furniture by inserting the pin in the central opening, forcing the plug to a recessed position with the socket providing means for preventing the pin and the components from tilting relative to the socket and to the piece of furniture.

2. The socket of claim 1 wherein the collar comprises means for protecting a surrounding upholstered surface on the piece of furniture.

3. The socket of claim 1 wherein the spring stop comprises a disk inserted into a second end of the sleeve and the means for attaching the sleeve to the piece of furniture comprises a fastener attached to the disk.

4. The socket of claim 3 wherein the fastener comprises a screw engagable with a threaded opening on an exterior surface of the disk.

5. The socket of claim 4 wherein the sleeve is crimped to attach the disk to the sleeve.

6. The socket of claim 3 wherein a post extends from the disk into the sleeve and through a portion of the spring, the post comprising means for limiting travel of the plug as the plug compresses the spring.

7. The socket of claim 1 wherein the spring comprises a coil spring.

8. The socket of claim 1 wherein the peripheral flange comprises an annular member having a diameter sufficient for an outer cylindrical edge of the flange to extend beyond an exterior cylindrical surface of the sleeve.

9. The socket of claim 8 wherein the collar comprises a tubular section extending centrally from the annular member, the central opening extending through the tubular section.

10. The socket of claim 9 wherein the tubular section includes an exterior groove with the sleeve crimped into the exterior groove to attach the collar to the sleeve.

11. An item of furniture comprising:

a socket for mounting a removable device on the item of furniture, the socket comprising a collar adapted to be attached to a first end of a separate sleeve, the collar including a peripheral flange extending outwardly from and laterally beyond the first end of the sleeve and extending over a portion of an exterior surface of the item of furniture, the sleeve extending into the item and attached to an interior frame member on the item of furniture;

the socket further including a central opening accessible from the exterior surface of the item of furniture and a plug extendable into the central opening;

the socket further including a spring located in the sleeve and biasing the plug into a position closing the central opening so that a portion of the removable device is inserted into the central opening;

the item of furniture including a hole in the exterior surface having a diameter less than a diameter of the collar but greater than an outer diameter of the sleeve so that the socket is inserted through the hole and mounted on the item of furniture with the collar extending over a portion of the exterior surface surrounding the hole.

12. The item of furniture of claim 11 wherein the sleeve is attached to the interior frame member at an opposite end of the sleeve from the collar.

13. The item of furniture of claim 11 comprising a chair with the socket being mounted on a chair arm.

14. An assembly for use on a chair to support an appliance for use by the occupant of the chair, the assembly comprising:

a socket comprising a sleeve with a collar on a first end of the sleeve, the collar having an annular peripheral flange extending outwardly from and laterally beyond the first end of the sleeve and a central opening extending through the collar and communicating with an interior cavity formed by the sleeve, the socket including means for mounting the socket to the chair at a location spaced from the first end of the sleeve;

the assembly further comprising a removable table with a pin extending from a bottom surface of the table, the pin being insertable into the central opening and being shorter than the sleeve, so that the table is adapted to be mounted on the chair and supported by the socket.

15. The assembly of claim 14 wherein the table is free to rotate relative to the socket.

16. The assembly of claim 14 including an end cap located on a second end of the sleeve.

17. The assembly of claim 16 wherein the end cap includes means for attachment of a fastener, the end cap and the fastener comprising means for mounting the socket to the chair at a location spaced from the first end of the sleeve.

18. The assembly of claim 16 including a plug located in the sleeve, the plug comprising means for closing the central opening in the collar.

19. The assembly of claim 18 including a spring normally urging the plug into a position closing the central opening.

20. The assembly of claim 18 wherein the end cap includes a post extending into the interior cavity of the sleeve, the post, the plug and the pin having a combined length greater than the height of the socket so that the table is supported in a position above the collar so as not to mar the collar.

* * * * *